US006488773B1

(12) United States Patent
Ehrhardt et al.

(10) Patent No.: US 6,488,773 B1
(45) Date of Patent: Dec. 3, 2002

(54) APPARATUS AND METHOD FOR SPRAYING POLYMER

(75) Inventors: Walter L. Ehrhardt, Mt. Pleasant, SC (US); Dennis L. Turocy, Goose Creek, SC (US)

(73) Assignee: Plastic Stuff, LLC, Charleston, SC (US)

( * ) Notice: Subject to any disclaimer, the term of this patent is extended or adjusted under 35 U.S.C. 154(b) by 48 days.

(21) Appl. No.: 09/637,546

(22) Filed: Aug. 11, 2000

Related U.S. Application Data

(63) Continuation-in-part of application No. 09/253,565, filed on Feb. 19, 1999, now abandoned.
(60) Provisional application No. 60/194,837, filed on Apr. 5, 2000.

(51) Int. Cl.[7] ..... B05B 7/16; B05C 5/00
(52) U.S. Cl. ..... 118/302; 239/135; 427/422
(58) Field of Search ..... 118/302, 300, 118/600; 239/8, 135, 427.5; 427/422

(56) References Cited

U.S. PATENT DOCUMENTS

| | | | | |
|---|---|---|---|---|
| 4,791,142 A | | 12/1988 | Pleuse et al. | 521/50 |
| 4,928,879 A | | 5/1990 | Rotolico | 239/8 |
| 5,102,484 A | | 4/1992 | Allen et al. | 156/244.11 |
| 5,180,104 A | | 1/1993 | Mellette | 239/8 |
| 5,242,633 A | | 9/1993 | Rook et al. | 264/8 |
| 5,326,241 A | | 7/1994 | Rook et al. | 425/7 |
| 5,405,085 A | | 4/1995 | White | 239/13 |
| 5,442,153 A | | 8/1995 | Marantz et al. | 219/121.47 |
| 5,478,014 A | | 12/1995 | Hynds | 239/135 |
| 5,544,811 A | | 8/1996 | Tillery et al. | 239/13 |
| 5,582,779 A | | 12/1996 | Gross et al. | 264/11 |
| 5,683,037 A | | 11/1997 | Rochman et al. | 239/536 |
| 5,687,906 A | | 11/1997 | Nakagawa | 259/8 |
| 5,692,884 A | | 12/1997 | Allen et al. | 417/361 |
| 5,730,912 A | | 3/1998 | Redd et al. | 264/4 |
| 5,856,377 A | | 1/1999 | Sato et al. | 523/201 |
| 5,931,578 A | * | 8/1999 | Womer et al. | 366/88 |
| 6,068,888 A | | 5/2000 | Forsythe et al. | 427/446 |
| 6,314,978 B1 | * | 11/2001 | Lanning et al. | 137/1 |

* cited by examiner

*Primary Examiner*—Richard Crispino
*Assistant Examiner*—Yewebdar T Tadesse
(74) *Attorney, Agent, or Firm*—Needle & Rosenberg, PC.

(57) ABSTRACT

A method of and apparatus for spraying a molten thermoplastic polymer composition onto a substrate. The thermal spray apparatus of the present invention includes a source of pressurized molten polymer material, a source of pressurized hot gas, and a spray head which is in fluid communication with the source of pressurized molten polymer material and a source of pressurized hot gas. The pressurized hot gas forms a flowstream as it exits the spray head and acts to atomize and transport the molten polymer material, in a molten state, to the substrate so that the substrate is coated. The molten polymer is atomized into relatively uniform particulates of molten plastic which aids in applying a uniform coating to the subject substrate. It is emphasized that this abstract is provided to comply with the rules requiring an abstract which will allow a searcher or other reader to quickly ascertain the subject matter of the technical disclosure. It is submitted with the understanding that it will not be used to interpret or limit the scope or meaning of the claims. 37 C.F.R. § 1.72(b).

32 Claims, 4 Drawing Sheets

APPARATUS AND METHOD FOR SPRAYING POLYMER

This application is a continuation-in-part application of Application Ser. No. 09/253,565, filed Feb. 19, 1999, which is abandoned, and claims priority to the provisional application No. Ser. 60/194,837, filed Apr. 5, 2000.

BACKGROUND OF THE INVENTION

1. Field of the Invention

This invention relates generally to a spray apparatus and methods of applying coatings of polymers to application surfaces. More particularly, this invention relates to a method and apparatus for transforming a solid polymer into its molten state and transporting the molten polymer to a spray head for subsequent delivery, in combination with a heated pressurized gas stream, in the form of molten droplets. When the molten polymer droplets strike the application surface, they adhere and combine to form a solid coat of polymer upon cooling.

2. Description of Related Art

It has long been appreciated that thermoplastic polymer coatings offer advantages over solvent-based coatings for providing protection afforded the substrate and to the process (in elimination of solvent vapors to the environment). The coated substrate enjoys enhancement in adhesion, chemical resistance, flex strength/modules, impact resistance, and repairability, as well as providing a broader range of material properties in the polymer coating. The substrate to be coated can be any material relatively resistant to heat, including wood, metals, glass, fibrous glass reinforced synthetic resin, or even cardboard without damaging the material surface. Employing the invention apparatus for applying a polymer coating instead of methods employed in applying a solvent-based coating material offers the environmental advantages of (1) safe and easy transportation, storage, and handling of non-hazardous raw materials; (2) no volatile organic compound (VOC) emissions during application; (3) no hazardous waste generated; and (4) no toxic organic chemical solvents or thinners, as well as the advantages of (5) no messy overspray (with attendant product loss) and (6) no shelf or pot life restrictions.

The earliest thermoplastic polymer coatings were electrostatic powder coatings, which involved electrostatic attraction/attachment of the thermoplastic polymer in powder form onto the metallic surface and heating to temperatures causing the polymer to melt and flow to form a continuous film. While effective, this process suffers practical limitations. The coating cannot be applied in the field. The size of the item to be coated is limited to the size of the curing/melting oven. Further, the thickness of the coating is limited by the electrical insulation (reducing or eliminating the electrostatic attraction force) as the powder thickness increases.

Alternatively, it is known to coat substrate surfaces using flame (or thermal) coating technology. Known thermal spray processes are characterized by chemical combustion heating including powder flame spraying, wire/rod flame spraying, and detonation/explosive flame spraying, and by electrical heating processes including plasma flame spraying. Plasma flame spraying involves the use of an ionized gas consisting of free electrons, positive ions, atoms, and molecules as a means of heating a material, such as metal powder, to a molten state at a high temperature and depositing the metal as a coating on a substrate, such as a chrome plate on an automobile part.

There are a number of known devices for spraying powders of high temperature thermoplastics or other high temperature polymer coatings to a variety of surfaces such as U.S. Pat. No. 3,676,638, which discloses a nozzle whereby powder is fed into the plasma stream downstream from the arc. U.S. Pat. No. 2,774,625 teaches an apparatus which uses detonation waves in spraying powders. U.S. Pat. No. 3,111,267 teaches a thermal spray gun apparatus for applying heat fusible coatings on solid objects wherein powder material is fed directly through a heating zone in the spray in which it reaches a molten or, at least, a hot plastic condition and is then propelled at a relatively high velocity onto the object to be coated. U.S. Pat. No. 3,627,204 discloses a spray nozzle arrangement for plasma gun wherein powder material is fed into a spray nozzle downstream of an arc chamber. U.S. Pat. Nos. 4,004,735 and 4,231,518 teach apparatuses for a detonating application of coating with powdered material. U.S. Pat. No. 4,290,555 teaches a method for introducing powder into a gas stream to be provided to a burner. U.S. Pat. No. 4,370,538 teaches an apparatus for spraying heated powder and the like wherein the apparatus includes a combustion chamber which is cooled by air flowing through an annular passage. U.S. Pat. No. 4,688,722 discloses a nozzle assembly for a plasma spray gun. Also, U.S. Pat. No. 4,911,363 teaches a flame spray apparatus including a combustion head provided with radially spaced longitudinal channels extending inwardly from the periphery thereof along which water passes to cool the combustion head. Finally, U.S. Pat. No. 5,520,334 discloses an air and fuel mixing chamber for a tuneable, high-velocity, thermal spray gun.

While overcoming some of the limitations of electrostatic polymer coating processes, flame coating is inefficient in that it creates new concerns and presents practical limitations of its own. These concerns and limitations relate to the common requirements of all conventional thermal spray systems: first, an open flame (or the equivalent thereof) to melt the thermoplastic polymer; and, second, the necessity that the polymer fed to the spray system be in powder form. In addition to its high-cost, plastic powder is difficult to handle and is conducive to material loss.

It is manifest that any open flame is dangerous and presents serious hazards, both to the applicator and to anyone in his general vicinity. The industrial use of flame spray coating processes essentially amounts to placing flame throwers into the hands of workers in a manufacturing facility. Another impediment to the efficiency of such processes is that plastic is a good insulator. Melting the plastic presents a heat transfer problem. Transferring heat energy into plastic by way of conduction is inefficient. Even a very hot flame is a slow, inefficient solution to the basic heat transfer problem. As a result, most flame systems can spray only about ten (10) pounds of plastic per hour or less. To compound the inefficiency of this slow delivery, most flame spray systems result in only a part of the delivered material being applied to the target substrate material. The application process is dangerous, expensive, and slow.

The velocity of a low velocity flame spray chemical process produces a coating of low bond strength and uneven particle melt; wherein some of the thermoplastic particles are amorphous, and overheated particles are crystalline. The plastic particle's exposure to heat energy is limited to its residence time in the flame. Each particle must reach its melt/sticky temperature during this residence time. Too short a residence time results in particles, that do not achieve this temperature, and thus do not stick to the target surface. The particles that do not stick to the surface fall off and become waste/scrap material. Too long a residence time results in particles that melt and then bum, or crystallize.

The problem of slow delivery has been addressed by one practitioner. Weidman, in U.S. Pat. Nos. 5,041,713 and 5,285,967, discloses high velocity thermal spray guns for spraying a melted powder of thermoplastic compounds onto a substrate to form a coating thereon. The latter patent, in particular, discloses a gun including a high velocity, oxygen fueled (HVOF) flame generator for providing an HVOF gas stream to a fluid cooled nozzle. The heat transfer problem is addressed by diverting a portion of the gas stream for preheating the powder, with the preheated powder being injected into the main gas stream at a downstream location within the nozzle. This method/apparatus approach to overcoming the heat transfer problem to produce a higher velocity spray still leaves concerns associated with the high temperature arc/flame exposure danger and the reliance on a thermoplastic polymer powder as the raw material.

The powder form of the thermoplastic polymer has continued as the material of choice for several reasons. Inasmuch as the powder is the only acceptable form of the material for the earlier electrostatic process for coating substrates, it was logical that the later developed high velocity delivery equipment be designed for the same form of material. Also, manufacturers and marketers of plastic flame coating equipment normally also manufacture and market thermoplastic polymer powder "specifically designed" for their equipment. For example, one company's flame coat powder "No. III," manufactured by Dupont and sold as Nucrelo™, sells for $10.50 per pound. The same Nucrelo™ material can be purchased in pellet form for $2.00 per pound. Therefore, the ability to use a larger particle size thermoplastic polymer material can provide a significant economic advantage.

The most common application of flame sprayed thermoplastic coatings is for the protection of metals against corrosion. A properly applied polymer coating is perhaps the most effective corrosion barrier available. For this performance, industries involved with corrosive materials, applications, and/or environments are willing to accept the various disadvantages discussed above. Nevertheless, there is a need for an improved method and/or apparatus for applying thermoplastic polymer compositions on substrate surfaces.

In particular, there is a need for the ability to apply a high volume of thermoplastic polymer coating in a short time. There is a need for a clean and efficient system that applies accurately with little or no waste from over spraying. There is a need for a system that is safe in an industrial environment, both from the perspective of safety for the user and for the facility. There is a need for the ability to apply a wide range of materials in various forms, such as pellets, regrind, recycled, or blended plastic materials, as well as powdered. A system which meets all these objectives is necessarily safer, environmentally friendlier, and more economical than currently available thermal spray systems.

SUMMARY OF THE INVENTION

The present invention is directed to an apparatus and method for spraying a molten thermoplastic polymer composition onto a substrate, preferably in the absence of a flame or a high-temperature arc. The thermal spray apparatus of the present invention includes a source of pressurized molten polymer material, a source of pressurized hot gas, and a spray head which is in fluid communication with the source of pressurized molten polymer material and the source of pressurized hot gas. The pressurized hot gas forms a flowstream as it exits the spray head and acts to atomize and transport the molten polymer material, in a molten state, to the substrate so that the substrate is coated. The molten polymer is atomized into relatively uniform particulates of molten plastic which aids in applying a uniform coating to the subject substrate.

The spray head has an input coating passage, a separate input air passage, and a nozzle assembly. The input coating passage is in fluid communication with the source of pressurized molten polymer coating material and the input air passage is in fluid communication with the source of pressurized hot gas. The nozzle assembly has a spray surface, a hot air receiving chamber, a plurality of air delivery conduits, and a coating material conduit. The hot air receiving chamber is in fluid communication with the input air passage. The air delivery conduits extend from the air receiving chamber to the spray surface of the nozzle assembly and define a plurality of air orifices. The air delivery conduits are in fluid communication with the hot air receiving chamber. Thus, when operational, hot pressurized gas exits the air orifices to form the flowstream which is at both a high temperature and high velocity.

The coating material conduit extends from the input coating passage to the spray surface of the nozzle assembly and defines a material orifice. The plurality of air orifices surround at least a portion of the material orifice so that, when operational, molten polymer exits the material orifice and subsequently interacts with the hot pressurized gas exiting the air orifices. The molten polymer is subsequently atomized by and transported to the substrate by the flowstream.

DETAILED DESCRIPTION OF THE FIGURES

DETAILED DESCRIPTION OF THE INVENTION

Figure 1:
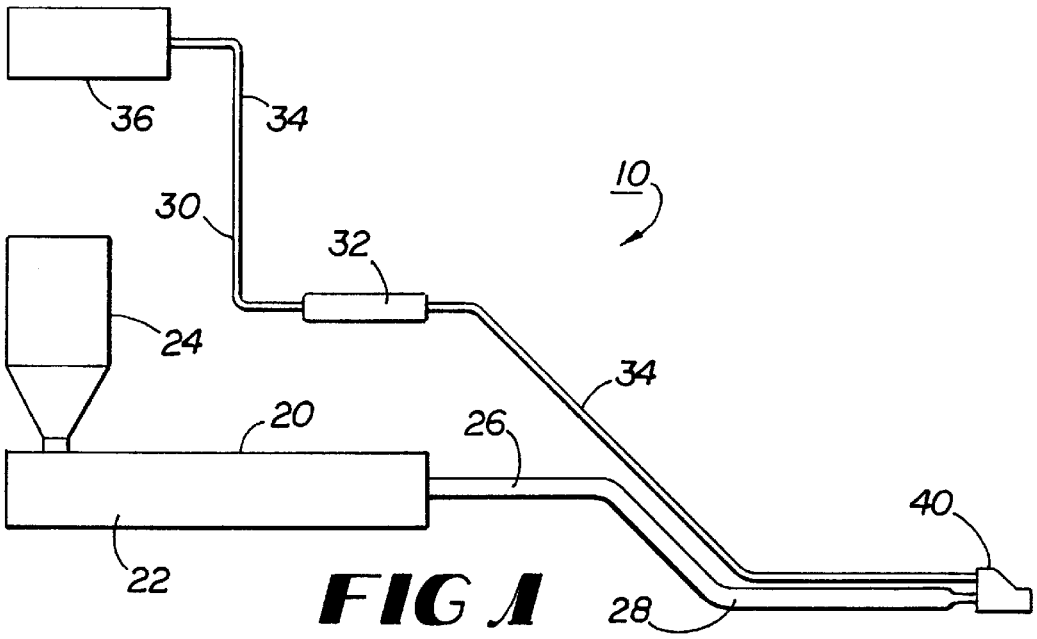
FIG. 1 is a schematic view of one embodiment of a thermal spray apparatus showing a source of pressurized molten polymer and a source of pressurized hot gas in fluid communication with a spray head.

The present invention is more particularly described in the following examples that are intended as illustrative only since numerous modifications and variations therein will be apparent to those skilled in the art. As used in the specification and in the claims, "a," "an," or "the" can mean one or more, depending upon the context in which it is used. The preferred embodiment is now described with reference to the figures, in which like numbers indicate like parts throughout the figures.

Referring generally to FIGS. 1–9, the thermal spray apparatus 10 of the present invention includes a source of pressurized molten polymer material 20, a source of pressurized hot gas 30, and a spray head 40 which is in fluid communication with the source of pressurized molten polymer material 20 and the source of pressurized hot gas 30. The pressurized hot gas 30 forms a high-energy flowstream F as it exits the spray head 40 and acts to atomize and transport the molten polymer material, in a molten state, to the substrate so that the substrate is coated with the polymer material. The molten polymer is atomized into relatively uniform fine particles of molten plastic, which aids in applying a uniform coating to the subject substrate.

The spray head 40 has an input end 42, a spray end 44, an input coating passage 46, a separate input air passage 48, and a nozzle assembly 50. The input coating passage 46 extends therein to the input end 42 of the spray head 44 and is in fluid communication with the source of pressurized molten polymer material 30. The input air passage 48 also extends therein to the input end 42 of the spray head 44. The input air passage 48 is separate from the input coating passage 46 and is in fluid communication with the source of pressurized hot gas 30.

The nozzle assembly 50 forms the spray end 44 of the spray head 40 and has a spray surface 52, a hot air receiving chamber 54, a plurality of air delivery conduits 56, and a coating material conduit 60. The hot air receiving chamber 54 is in fluid communication with the input air passage 48. The air delivery conduits 56 extend from the hot air receiving chamber 54 to the spray surface 52 of the nozzle assembly 50 and define a plurality of air orifices 58. The air delivery conduits 56 are in fluid communication with the hot air receiving chamber 54. Thus, when operational, hot pressurized gas exits the air orifices 58 to form the high-energy flowstream F which is at both a high temperature and high velocity. The hot pressurized gas discharged through the air orifices 58 exit each air orifice 58 on an axis generally aligned with the major longitudinal axis $L_a$ of the respective air delivery conduits 56.

The coating material conduit 60 extends from the input coating passage 46 to the spray surface 52 of the nozzle assembly 50 and defines a material orifice 62. The molten polymer preferably exits the material orifice 62 in a stream that is generally co-axial to the major longitudinal axis $L_c$ of the coating material conduit 60. The molten polymer is subsequently atomized by and transported to the substrate by the high energy flowstream F. The air orifices 58 are preferably in close proximity to the material orifice 62 for increased efficiency in atomizing the molten polymer and transporting it to the substrate after exiting the spray end of the spray head. The spacing between the air orifices 58 and the material orifice 62 may vary within a relatively wide range, depending on several factors including dimensions of the air delivery conduits 56 and the coating material conduit 60 and operating conditions. Preferably the spacing should be less than 3 inches, with less than 1.5 inches being more preferred.

Figure 3A:
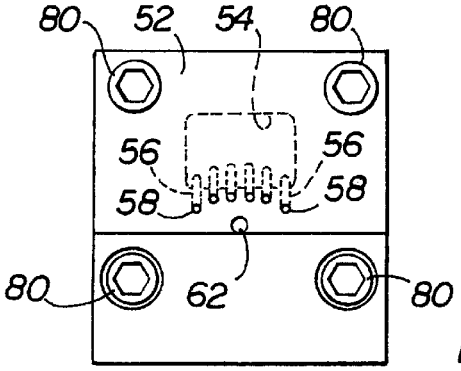
FIG. 3A is a front view of the spray head and nozzle assembly of FIG. 2 showing a plurality of air delivery conduits arranged in an arcuate pattern surrounding a portion of a material orifice.

Referring to FIG. 3A, a number of different geometries of the air orifices 58, relative to the material orifice 62, are contemplated. Preferably, the plurality of air orifices 58 surround at least a portion of the material orifice 62. In one embodiment, the plurality of air orifices 58 may be arranged in a line pattern oriented to one side of the material orifice 62. Alternatively, two opposing line patterns oriented to the sides of the material orifice 62 may be utilized. This opposing line patterns may be parallel to each other, or may have a "V" shape in front end view. In another example, the plurality of air orifices 58 may have an arcuate pattern or shape oriented to one side of the material orifice 62. Additionally, square, rectangle, circular, triangle, and other such geometric patterns of air orifices 58 surrounding the material orifice 62 may be utilized.

Figure 2:
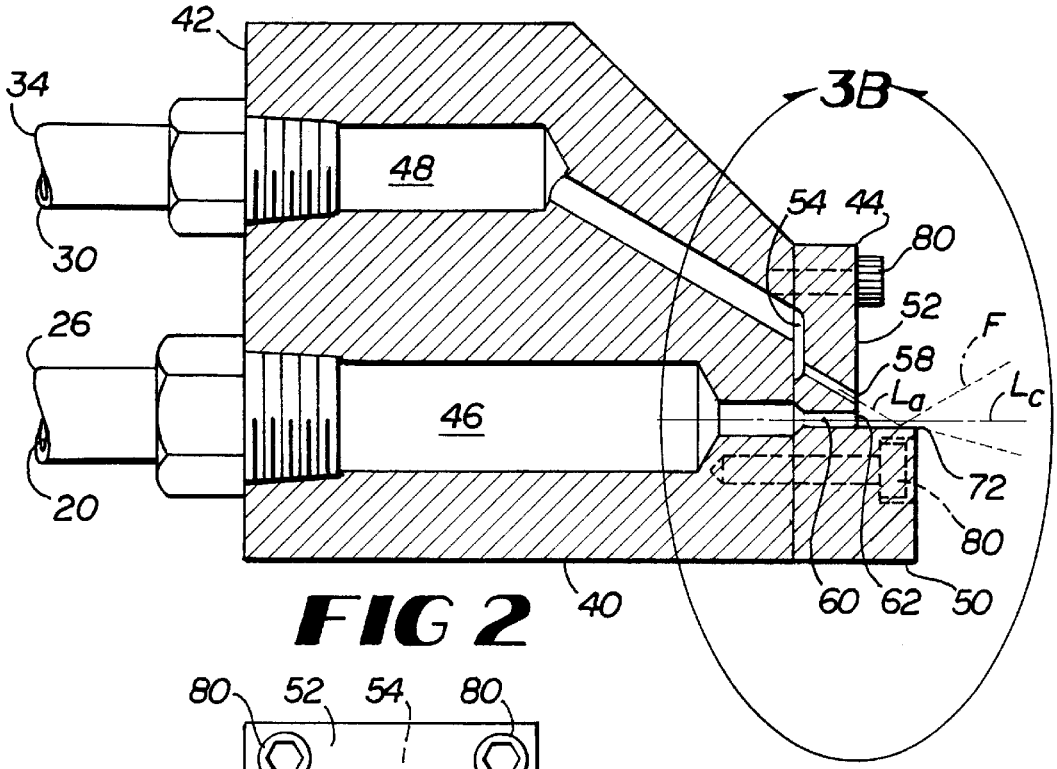
FIG. 2 is a partial cross-sectional view of the thermal spray apparatus showing the spray head of FIG. 1 with a first embodiment of a nozzle assembly.
Figure 3B:
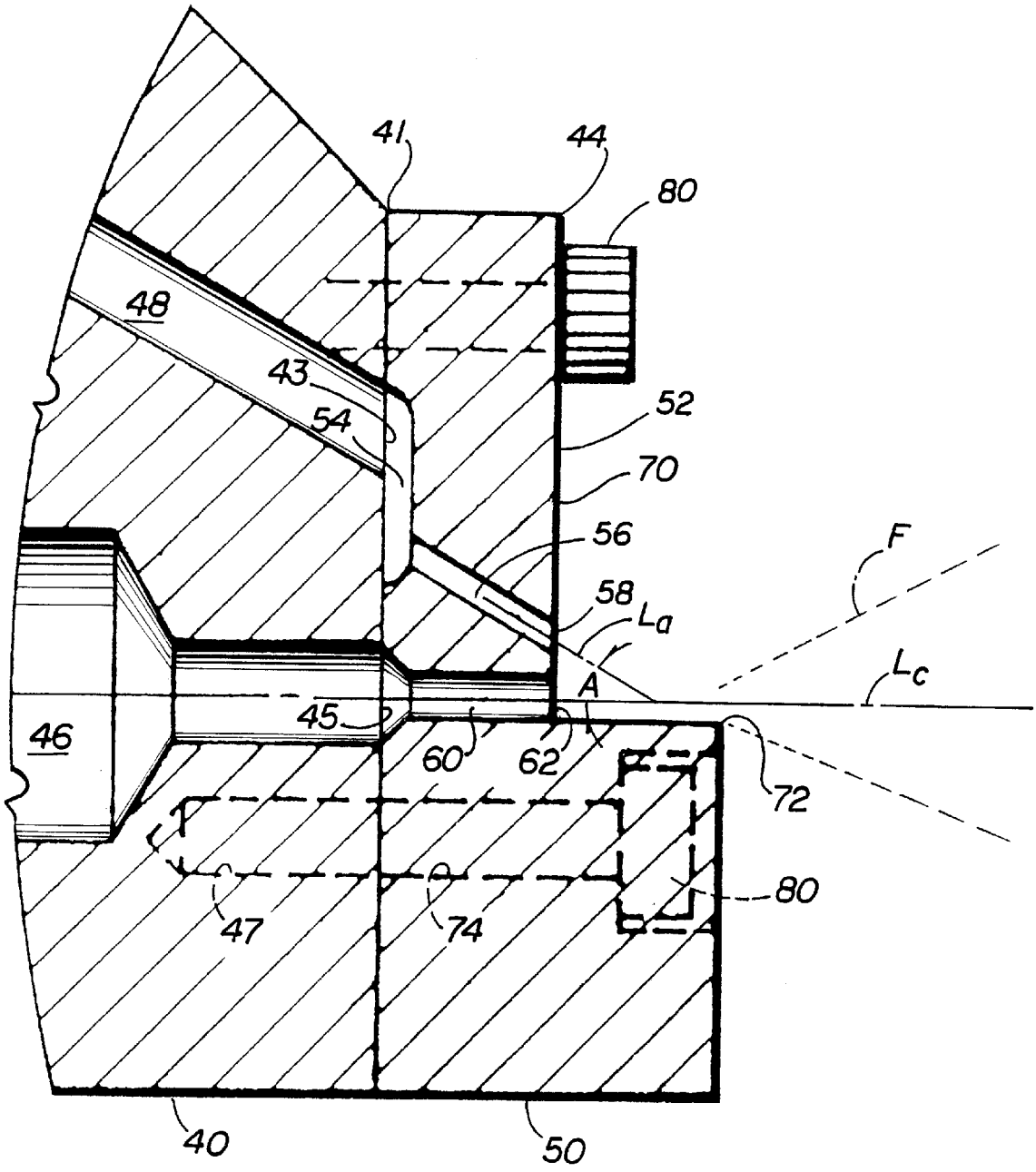
FIG. 3B is an enlarged detail section taken at inset circle 3A in FIG. 2.

Referring to FIGS. 2–3B, in one embodiment of the nozzle assembly 50, the plurality of air orifices 58 are arranged in a pattern, such as an arcuate pattern or a line pattern, oriented to one side of the material orifice 62. In this embodiment, it is preferred that the nozzle assembly 50 have a substantially "L" shape in cross-section, in which the "L" shape is formed by an integrally connected upright portion 70 and a base portion 72. The material orifice 62 is intermediate the preferred pattern of the plurality of air orifices 58 and the longitudinally-extending base portion 72 of the nozzle assembly 50. A portion of the upright portion 70 includes the spray surface 52 of the nozzle assembly 50. In this "L" shape, the base portion 72 extends longitudinally outwardly away from the spray surface 52. It is preferred that the base portion 72 be parallel to the longitudinal axis $L_1$ of the coating material conduit 60 so that when the molten polymer material initially exits the material orifice 62 along the longitudinal axis $L_c$ of the coating material conduit 60, the stream of molten polymer material is preferably initially discharged generally parallel to the base portion 72.

In this embodiment, it is preferred that each of the air delivery conduits 56 formed in the upright portion 70 of the nozzle assembly 50 be inclined downwardly toward the material orifice 62 of the coating material to form an acute angle A relative to the longitudinal axis $L_c$ of the coating material conduit 60. The acute angle A is defined by: 1) the longitudinal axis $L_a$ of the air delivery conduit 56; and 2) a plane passing through the longitudinal axis $L_c$ of the coating material conduit 60 and the air orifice 58 of the air delivery conduit 56. Thus, the pressurized hot gas exiting the air orifices 58 converges with and entrains the molten polymer exiting the material orifice 62 at an intermediate point a predetermined distance from the spray surface 52. The molten polymer material which thereby becomes entrained in the high-energy flowstream F comes into contact with a portion of the base portion 72 of the nozzle assembly 50 where it is atomized and subsequently defected toward and transported onto the substrate.

In this embodiment of the spray head 40, the nozzle assembly 50 may be detachably secured to the body of the spray head 40 by mechanical fasteners 80 or the like. In one example, the body of the spray head 40 has a mounting surface 41 defining an air opening 43 and a material opening 45. As one skilled with the art will appreciate, the air opening 43 is the distal end of the input air passage 48 and the material opening 45 is the distal end of the input coating passage 46. The mounting surface 41 further defines at least one mounting bore 47 that extends at least partially therein. The nozzle assembly 50 has at least one aperture 74 that extends through the nozzle assembly 50 module generally traverse to the spray surface 52 of the nozzle assembly 50. Each mounting bore 47 is co-axial with one aperture 74 when the nozzle assembly 50 is detachably secured to the mounting surface 41 of the spray head 40. When the nozzle assembly 50 is secured to the mounting surface 41 of the spray head 40, the air opening 43 of the mounting surface 41 abuts the hot air receiving chamber 54 of the nozzle assembly 50 so that the input air passage 48 is in fluid communication with the hot air receiving chamber 54. Also, the material opening 45 abuts the coating material conduit 60 so that the input coating passage 46 is in fluid communication with the coating material conduit 60.

As one skilled in the art will appreciate, the nozzle assembly 50 may be connected to the spray head 40 by any suitable means, such as, for example, a mechanical fastener 80, such as, a screw or bolt. In this example, the mechanical fastener 80 is inserted into the aperture 74 of the nozzle assembly 50 and is detachably engaged within the mounting bore 47 of the mounting surface 41. To accommodate the use of a treaded mechanical fastener 80, the mounting bore 47 and/or the aperture 74 may have a complementary threaded surface.

Figure 4:
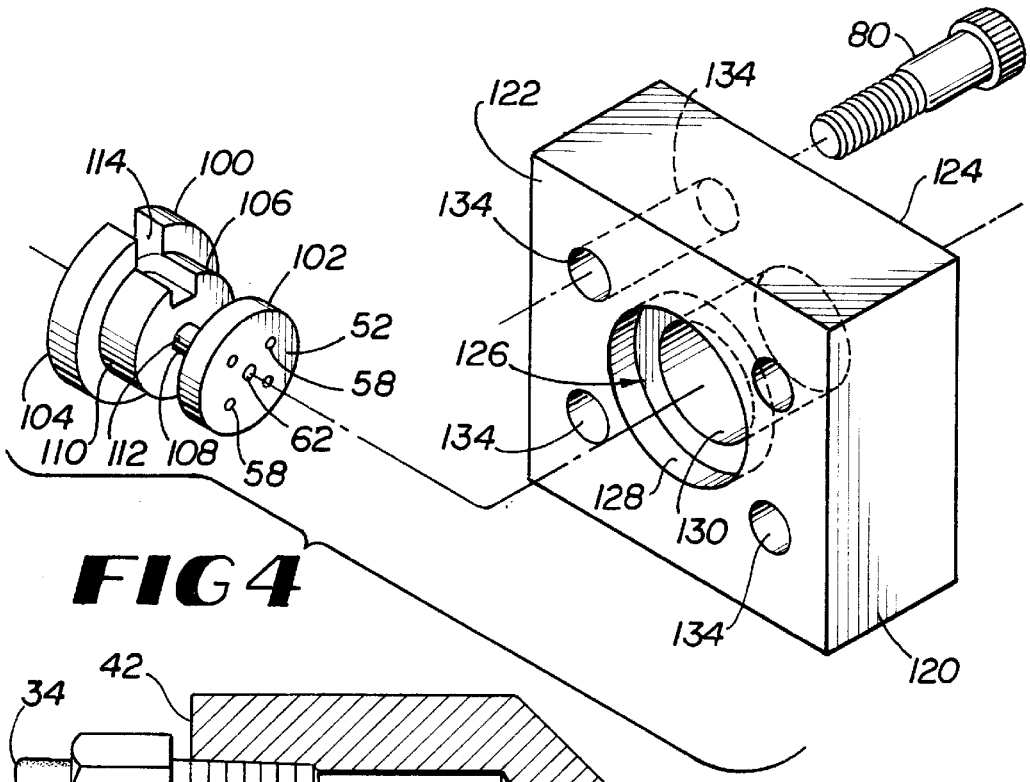
FIG. 4 is an exploded perspective view of a second embodiment of a nozzle assembly showing a plug member insertable therein a hollow shell.
Figure 5:
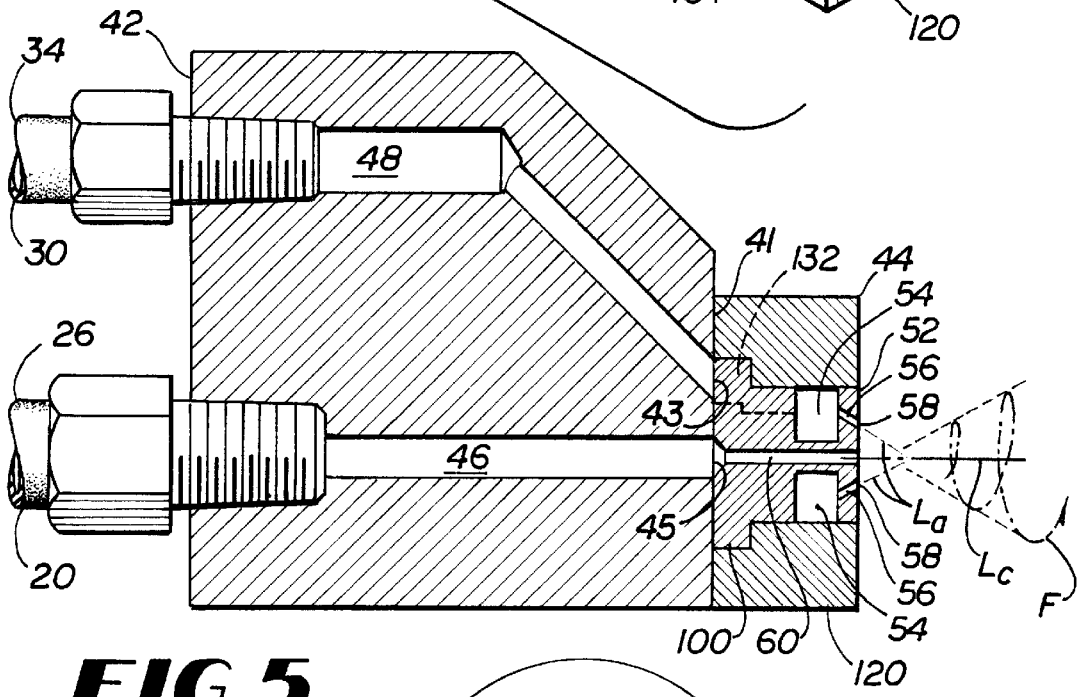
FIG. 5 is a partial cross-sectional view of the thermal spray apparatus showing the second embodiment of the nozzle assembly of FIG. 4 secured to a mounting surface of the spray head.
Figure 6:
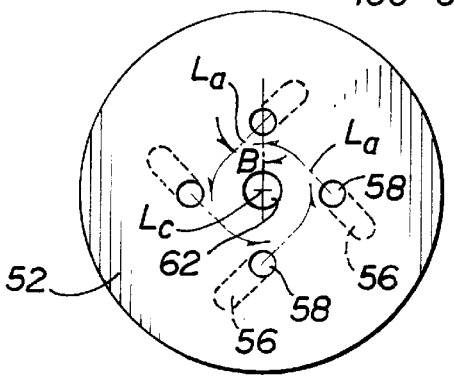
FIG. 6 is a front view of an embodiment of the spray surface of the plug member of the second embodiment of the nozzle assembly showing the skew angle B.
Figure 7:
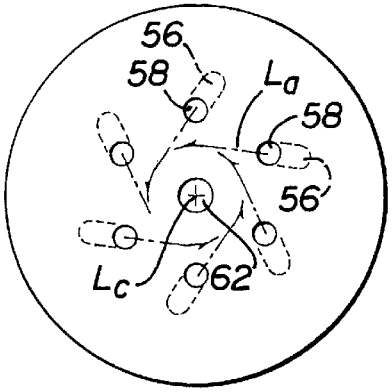
FIG. 7 is a front view of an embodiment of the spray surface of the plug member of the second embodiment of the nozzle assembly.

Referring now to FIGS. 4–9, in a second embodiment of the nozzle assembly 50, the coating material conduit 60 has a longitudinal axis $L_c$ and the plurality of air delivery conduits 56 has a longitudinal axis $L_a$. Each air delivery conduit 56 is inclined and skewed inwardly toward the material orifice 62 of the coating material conduit 60 at a compound angle. As one skilled in the art will appreciate, the molten polymer exits the material orifice 62 as a molten steam traveling along an axis which in generally co-axial to the longitudinal axis $L_c$ of the coating material conduit 60. In this embodiment, each of the air delivery conduits 56 have a major direction component that is in the direction radially inwardly with respect to the longitudinal axis $L_c$ of the coating material conduit 60. Thus, the radially inwardly component is skewed at a skew angle B with respect to the radial direction of the longitudinal axis $L_c$ of the coating material conduit 60. The skew angle B is illustrated in FIG. 6, as being the acute angle defined by: 1) the plane passing through the longitudinal axis $L_a$ of the same air delivery conduit 56; and 2) a plane passing through the longitudinal axis $L_c$ of the coating material conduit 60 and the center of the respective air orifice 58. The skew angle B is preferably between about 20° and 80°, more preferably between about 40° and 75°, and most preferably between about 50° and 70°.

Figure 9:
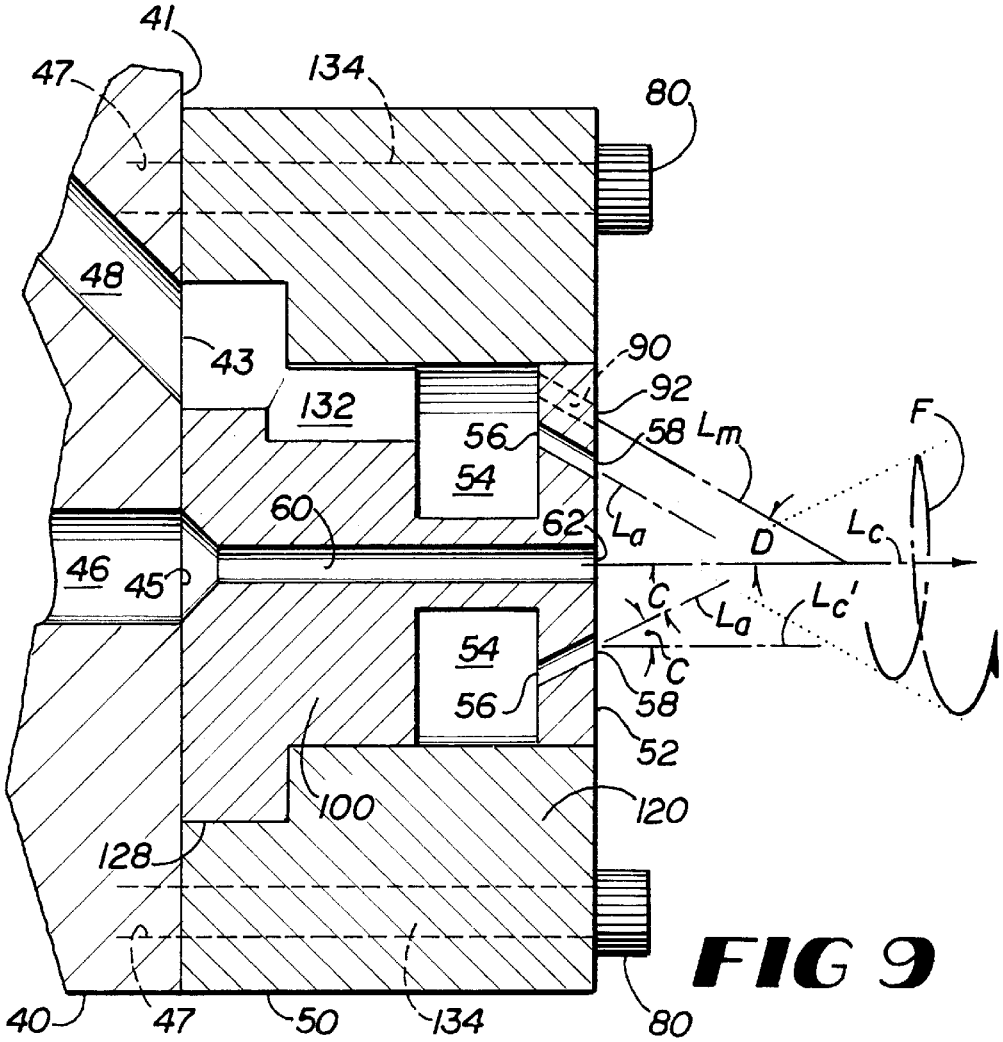
FIG. 9 is a partial cross-sectional view of the thermal spray apparatus taken across line 9—9 of FIG. 8 showing the second embodiment of the nozzle assembly secured to a mounting surface of the spray head.

Additionally, as shown in FIG. 9, it is preferred that each of the air delivery conduits 56 are inclined at an acute angle C which is defined by: 1) the longitudinal axis of the air delivery conduit 56; and 2) a plane passing through the axis $L_c$ of the coating material conduit 60 and the center of the respective air orifice 58. In other words, the longitudinal axis $L_a$ of each of the air delivery conduits 56 defines the angle C with a line $L_c$. (co-axial to the longitudinal axis $L_c$ of the coating material conduit 60) passing through the center of the air orifice 58. The acute angle C is referably between about 10° and 70°, more preferably between about 30° and 60°, and most preferably between about 40° and 50°.

Discharged hot pressurized gas exits each of the air orifices 58 generally along the axis of the air delivery conduits 56 and, because of the compound angle of the air delivery conduits 56, formed by the combination of the acute angle C and the skew angle B, the discharged gas avoids the axis of the exiting molten polymer stream. Instead, the exiting hot-pressurized gas forms a high-energy flowstream F that, in this embodiment, is characterized by a swirling motion. This swirling motion creates a tornado effect. This air circulation of the tornado effect creates a low-pressure area near the material orifice 62 which acts to draw the molten polymer steam to the high-energy flowstream F and to atomize the molten polymer. The atomized molten polymer is subsequently entrained in the high-energy flowstream F which transports the atomized molten polymer, in a molten state, to the subject substrate to provide a continuous film coating thereon. The heat of the polymer and air keeps the plastic in its molten state until it strikes the target.

Figure 8:
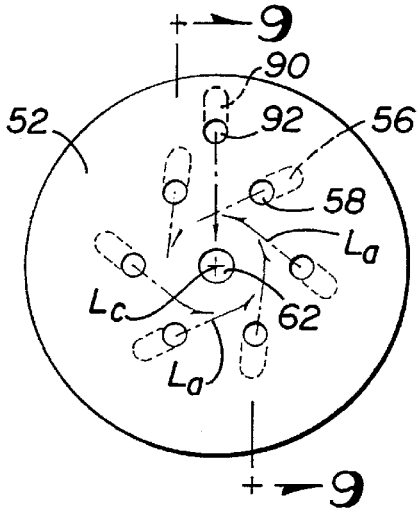
FIG. 8 is a top view of an embodiment of the spray surface of the plug member of the second embodiment of the nozzle assembly showing an air mixing conduit in combination with a plurality of air delivery conduits and the coating material conduit.

As shown in FIGS. 8 and 9, the spray head 40 may also have an air mixing conduit 90. The air mixing conduit 90 has a longitudinal axis $L_m$ and extends from the hot air receiving chamber 54 to the spray surface 52 to define an air mix orifice 92. The air mixing conduit 90 is inwardly inclined toward the material orifice 62 at an acute angle D with respect to the longitudinal axis $L_c$ of the coating material conduit 60. The acute angle D defined by the acute angle formed by the intersection of the longitudinal axis $L_c$ of the coating material conduit 60 and the longitudinal axis $L_m$ of the air mixing conduit 90. In this embodiment, the hot gas that discharges from the air mixing orifice 92 converges with the gas discharges from the plurality of air orifices 58 and the axis of the exiting molten polymer a predetermined distance from the spray surface 52 and aids in uniformly dispersing the molten polymer droplets within the high-energy flowstream F.

In this embodiment, the nozzle assembly 50 is preferably formed from a generally cylindrical plug member 100 and a hollow shell 120. The plug member 100 is sized to be complementarily received and seated within the hollow shell 120. Referring to FIGS. 4, 5 and 9, the plug member 100 has a first end 102 and a second end 104, the first end 102 forming the spray surface 52 and defining the air orifices 58 and the material orifice 62, and the second end 104 defining the proximal end of the coating material conduit 60. The plug member 100 further defines a first circumferentially-extending groove 106 near the second end 104 of the plug member 100 that forms a first waist 110 having a diameter less than the diameter of the second end 104 of the plug member 100 and substantially similar to the diameter of the first end 102 of the plug member 100. Still further, the plug member 100 defines a second circumferentially-extending groove 108 intermediate the first waist 106 and the first end 102 to form a second waist 112. The second waist 112 has a diameter less than the diameter of the first waist 106 and the first end 102 of the plug member 100. The plug member 100 also has a channel 114 extending partially therein the circumferential edge of the second end 104 and the first waist 110.

The hollow shell 120 has a first side 122 and an opposite second side 124. The hollow shell 120 defines a stepped-bore 126 extending traversly through the hollow shell 120 from the first side 122 to the second side 124. The stepped-bore 126 has a first portion 128 proximate the first side 122 and a second portion 130 extending from the first portion 122 to the second side 124. The first portion 128 of the stepped-bore 126 has a diameter substantially equal to the diameter of the second end 104 of the plug member 100 so that the second end 104 of the plug member 100 may be complementarily secured within the first portion 128 of the stepped-bore 126. The second portion 130 of the stepped-bore 126 has a diameter substantially equal to the diameter of the first end 102 and the first waist 110 of the plug member 100 so that the first waist 110 and the first end 102 of the plug member 100 may be complementarily secured within the second portion 130 of the stepped-bore 126.

When the plug member 100 is complementarily seated within the shell 120, the plug member 100 is secured relative to the shell 120 so that the first side 122 of the shell 120 is preferably substantially planar to the second end 104 of the plug member 100 and the second side 124 of the shell 120 is preferably substantially planar to the first end 102 of the plug member 100. Additionally, and as one skilled in the art will appreciate, when the plug member 100 is complementarily seated and secured within the shell 120, the second waist 112 of the plug member 100 and a portion of the interior surface of the second portion 130 of the stepped-bore 126 forms the hot air receiving chamber 54 of the spray head 40 and the channel 114 of the plug member 100 and the surrounding portions of the first and second portions 128, 130 of the stepped-bore 126 form an air duct 132 that extends from the second end 104 of the plug member 100, where it abuts the air opening 43 therein the mounting surface 41, to the formed hot air receiving chamber 54 to fluidly communicate hot pressurized gas from the input air passage 48 to the air delivery conduits 56 and, if used, the air mixing conduit 90.

Similar to the first embodiment, as one skilled in the art will appreciate, the nozzle assembly 50 may be detachably secured to the mounting surface 41 of the spray head 40 by any suitable means, such as, for example, a mechanical fastener, such as, a screw or bolt. In one example, to detachably secure the nozzle assembly 50, the hollow shell 120 has at least one aperture 134 that extends traversly through the shell 120 from the first side 122 to the second side 124. Each mounting bore 47 within the mounting surface 41 is co-axial with one aperture 134 when the nozzle assembly 50 is detachably secured to the mounting surface 41 of the spray head 40. When the nozzle assembly 50 is secured to the mounting surface 41 of the spray head 40 (i.e., when the second side of the shell 120 and the substantially co-planar first end of the plug member 100 of the nozzle assembly 50 is secured to the mounting surface 41), the air opening 43 of the mounting surface 41 abuts the formed air duct 132 of the nozzle assembly 50 so that the input air passage 48 is fluidly connected to the hot air receiving chamber 54. Also, the material opening 45 abuts the proximal end of the coating material conduit 60 so that the input coating passage 46 is fluidly connected to the coating material conduit 60. In this example, the mechanical fastener is inserted into the aperture 134 of the shell 120 of the nozzle assembly 50 and is detachably engaged within the mounting bore 47 of the mounting surface 41. To accommodate the use of a treaded mechanical fastener, the mounting bore 47 and/or the aperture 134 may have a complementary threaded surface.

The source of pressurized molten polymer coating material preferably includes a colliquation means for converting a solid polymer to a molten polymer state and a heated supply conduit 26. One example of a suitable colliquation means is an extruder 22. The extruder 22 may be any commercially available extruding device, such as, for example, those wherein the material is forced through the extruder barrel with a screw, a ram, or plunger. An example of a suitable extruder 22 is a Davis Standard Extruder, Model No. 9159. The force employed to move the material through the extruder barrel and the heat energy generated from the friction resulting from the rapid movement along interface of the material and the internal wall of the extruder body causes the colliquation of the thermoplastic material, converting it from its initial solid state to a molten liquid state.

The colliquation means may include apparatus for melting polymer material such as, for example, thermoplastic material. The polymer material may be in the form of various shaped and sized pellets. It may be regrind, recycled, or powdered material. The thermoplastic material may be a composition of a single polymer component or a blend of multiple components (such as those disclosed in the prior art patents earlier discussed). In order to minimize the cost incurred in the use of the thermal spray apparatus, it is preferred that the polymer material utilized is in pelletized form.

The heated supply conduit 26 is fluidly connected to the colliquation means and the proximal end of the input coating passage 46 of the spray head 40. The heated supply conduit 26 can maintain the temperature of polymer material within the conduit 26 at a predetermined range so that the polymer remains in the desired the molten polymer state. Heated supply conduits of this type are known in the art. For example, the heated supply conduit 26 may comprised of an electrically heated, thermostatically controlled, supply conduit supplied by Diebolt (CH 6-15, J-220-J).

As needed, depending on the melt point of the material to be sprayed, the degree of liquefaction required by the substrate to be coated, and/or by the desired thickness of coating to be applied, heat may also be applied externally through the extruder barrel wall (such as with a thermal jacket 28). In the instance of a screw extruder 22, the output of the delivered molten polymer material can be controlled by adjustment of the rpm of the screw. Also, there may preferably be included an adjustable back pressure valve on the extruder screw or ram. The liquefied thermoplastic material is then transferred, through the heated supply conduit 26, to the spray head 40 for application for coating a substrate material.

The source of pressurized molten polymer coating further includes a means for feeding the polymer material, such as the preferred solid pelletized polymer material, into the colliquation means. For example the means for feeding may comprise a hopper 24 which directs polymer material into the colliquation means in a controlled manner.

The source of pressurized hot gas preferably includes a source of pressurized gas 36, a gas heater 32, and an insulated gas line 34 coupled to the gas heater 32 and the proximal end of the input air passage 48 so that gas may be delivered to the spray head 40 under pressure and at an elevated temperature. The gas heater 32 is known to one skilled in the art and is in fluid communication with the source of pressurized gas 36. The gas heater 32 increases the temperature of the pressurized gas to a predetermined temperature. The predetermined temperature of the pressurized gas is preferably in excess of the predetermined temperature of the molten polymer. The insulated gas line 34 allows the hot gas to be delivered to the proximal end of the input air passage 48 with limited temperature loss. Air is preferred, but other gases are contemplated such as nitrogen, argon, and the like.

The pumps and/or motors used in conjunction with the aforementioned equipment may be hydraulic, electric or gas powered. The horsepower of the selected motor powering the extruder 22 component will, in part, determine the capacity of the device. Thus, the greater the horsepower, the greater the potential volume of plastic sprayed per hour.

Although the present invention has been described with reference to specific detail of certain embodiments thereof, it is not intended that such details should be regarded as limitations upon the scope of the invention except as and to the extent that they are included in the accompanying claims.

What is claimed is:

1. A thermal spray apparatus for coating a substrate with a polymer coating material, the thermal spray apparatus comprising:

a) a source of pressurized molten polymer coating material;

b) a source of pressurized hot gas for generating a flowstream; and c) a spray head having:

i) an input coating passage, the input coating passage in fluid communication with the source of pressurized molten polymer coating material, ii) an input air passage, the input air passage in fluid communication with the source of pressurized hot gas, and iii) a nozzle assembly for directing the flowstream towards the substrate, the nozzle assembly having a spray surface, a hot air receiving chamber in fluid communication with the input air passage, a plurality of air delivery conduits extending from the hot air receiving chamber to the spray surface to define a plurality of air orifices in the spray surface, and a coating material conduit extending from the input coating passage to the spray surface to define a material orifice in the spray surface, wherein the coating material conduit has a longitudinal axis, wherein each air delivery conduit has a longitudinal axis, wherein the plurality of air delivery conduits are inclined and skewed with respect to the longitudinal axis of the coating material conduit, wherein the molten polymer exits the material orifice along an axis co-axial to the longitudinal axis of the coating material conduit, wherein each of the air delivery conduits has a major direction component in a direction radially inwardly with respect to the longitudinal axis of the coating material conduit, the radially inwardly component being skewed with respect to the radial direction of the it longitudinal axis of the coating material conduit so that hot gas discharges from the plurality of air orifices avoid the axis of the exiting molten polymer, and wherein the plurality of air orifices at least partially surround a portion of the material orifice, so that, when the pressurized hot gas exits the plurality of air orifices and the pressurized coating material exits the material orifice, the coating material is atomized and transported to the substrate in a molten state.

2. The thermal spray apparatus of claim 1, wherein the plurality of air orifices are arranged in a line pattern relative to the material orifice.

3. The thermal spray apparatus of claim 1, wherein the plurality of air orifices are arranged in an arcuate pattern relative to the material orifice.

4. The thermal spray apparatus of claim 1, wherein the coating material conduit has a longitudinal axis, wherein each air delivery conduit has a longitudinal axis, and wherein the plurality of air delivery conduits are inclined inwardly toward the material orifice of the coating material conduit to form an acute angle relative to the longitudinal axis of the coating material conduit, the angle defined by the longitudinal axis of the air delivery conduit and a plane passing through the longitudinal axis of the coating material conduit and the air orifice of the air delivery conduit, so that the pressurized hot gas exiting the plurality of air orifices converges with the molten polymer exiting the material orifice.

5. The thermal spray apparatus of claim 4, wherein the nozzle assembly has a substantially "L" shape in cross-section having a base portion and an upright portion, the base portion extending outwardly away from the upright portion substantially co-axial to the longitudinal axis of the coating material conduit, a portion of the upright portion forming the spray surface, and wherein the material orifice is proximate the base portion of the nozzle assembly.

6. The thermal spray apparatus of claim 5, wherein the plurality of air orifices are arranged in an arcuate pattern relative to the material orifice, and wherein the material orifice is intermediate the plurality of air orifices and the base portion of the nozzle assembly.

7. The thermal spray apparatus of claim 1, wherein each of the air delivery conduits are inclined at an acute angle, the angle defined by the longitudinal axis of the air delivery conduit and a plane passing through the longitudinal axis of the coating material conduit and the air orifice, the angle being between 10° and 70°.

8. The thermal spray apparatus of claim 7, wherein the skew angle is between 20° and 80°.

9. The thermal spray apparatus of claim 1, further comprising an air mixing conduit extending from the hot air receiving chamber to the spray surface to define an air mix orifice in the spray surface, the air mixing conduit having a longitudinal axis, wherein the air mixing conduit is inwardly inclined at an acute angle with respect to the longitudinal axis of the coating material conduit, the angle defined by the angle formed by the intersection of the longitudinal axis of the coating material conduit and the longitudinal axis of the air mixing conduit, the angle being between 10° and 70°, so that hot gas discharge from the air mixing orifice converges with the gas discharges from the plurality of air orifices and molten polymer discharged from the material orifice a predetermined distance from the spray surface.

10. The thermal spray apparatus of claim 1, wherein the plurality of air orifices are arranged in a substantially circular pattern around the material orifice.

11. The thermal spray apparatus of claim 1, wherein the source of pressurized molten polymer coating material comprises:

a) an extrusion means for converting a solid polymer to a molten polymer state; and b) a heated supply conduit in fluid communication with the extrusion means and the input coating passage, wherein the heated supply conduit maintains the polymer within the heated supply conduit in the molten polymer state.

12. The thermal spray apparatus of claim 11, wherein the extrusion means comprises a screw extruder.

13. The thermal spray apparatus of claim 11, wherein the source of pressurized molten polymer coating material further comprises a means for feeding the solid polymer into the extrusion means.

14. The thermal spray apparatus of claim 1, wherein the source of pressurized hot gas comprises:

a) a source of pressurized gas;

b) a gas heater adjacent the source of pressurized gas, the gas heater increasing the temperature of the pressurized gas to a predetermined temperature; and c) an insulated gas line coupled to the gas heater and the input air passage, wherein the gas, from the source of pressurized gas, is delivered to the input air passage under pressure and at a temperature above ambient.

15. A thermal spray apparatus for coating a substrate with a polymer coating material, the thermal spray apparatus comprising:

a) a source of pressurized molten polymer coating material;

b) a source of pressurized hot gas for generating a flowstream; and c) a spray head having:

i) an input end and a spray end, the spray end having a spray surface defining a plurality of air orifices and a coating material orifice;

ii) an input coating passage extending therein to the input end, the input coating passage in fluid communication with the source of pressurized molten polymer coating material, iii) a separate input air passage extending therein to the input end, the input air passage in fluid communication with the source of pressurized hot gas;

iv) a plurality of air delivery conduits extending therein to the spray surface of the spray end, each air delivery conduit extending inwardly from one air orifice and in fluid communication with the input air passage; and v) a coating material conduit extending therein to the spray surface of the spray end, the coating material conduit extending inwardly from the coating material orifice and in fluid communication with the input coating passage, wherein the coating material conduit has a longitudinal axis, wherein each air delivery conduits has a longitudinal axis, wherein the plurality of air delivery conduits are inclined and skewed with respect to the longitudinal axis of the coating material conduit, wherein the molten polymer exits the material orifice along an axis co-axial to the longitudinal axis of the coating material conduit, wherein each of the air delivery conduits has a major direction component in a direction radially inwardly with respect to the longitudinal axis of the coating material conduit, the radially inwardly component being skewed with respect to the radial direction of the longitudinal axis of the coating material conduit so that hot gas discharges from the plurality of air orifices avoid the axis of the exiting molten polymer, and wherein the plurality of air orifices at least partially surround a portion of the material orifice, so that, when the pressurized hot gas exits the plurality of air orifices and the pressurized coating material exits the material orifice, the coating material is atomized and transported to the substrate in a molten state.

16. The thermal spray apparatus of claim 15, wherein the plurality of air orifices are arranged in a line pattern relative to the material orifice.

17. The thermal spray apparatus of claim 15, wherein the plurality of air orifices are arranged in an arcuate pattern relative to the material orifice.

18. The thermal spray apparatus of claim 15, wherein the coating material conduit has a longitudinal axis, wherein the air delivery conduit has a longitudinal axis, and where each air delivery conduit is inclined inwardly toward the material orifice of the coating material conduit to form an acute angle relative to the longitudinal axis of the coating material conduit, the angle defined by the longitudinal axis of the air delivery conduit and a plane passing through the longitudinal axis of the coating material conduit and the air orifice of the air delivery conduit, so that the pressurized hot gas exiting the plurality of air orifices converges with the molten polymer exiting the material orifice.

19. The thermal spray apparatus of claim 18, wherein the spray end has a substantially "L" shape in cross-section having a base portion and an upright portion, the base portion extending outwardly away from the upright portion substantially co-axial to the longitudinal axis of the coating material conduit, a portion of the upright portion forming the spray surface defining the air orifices and the material orifice, and wherein the material orifice is proximate the base portion of the nozzle assembly.

20. The thermal spray apparatus of claim 19, wherein the plurality of air orifices are arranged in an arcuate pattern relative to the material orifice, and wherein the material orifice is intermediate the plurality of air orifices and the base portion of the nozzle assembly.

21. The thermal spray apparatus of claim 15, wherein each of the air delivery conduits are inclined at an acute angle, the angle defined by the longitudinal axis of the air delivery conduit and a plane passing through the longitudinal axis of the coating material conduit and the air orifice, the angle being between 10° and 70°, and wherein the skew angle is between 20° and 80°.

22. The thermal spray apparatus of claim 21, further comprising an air mixing conduit extending from the hot air receiving chamber to the spray surface to define an air mix orifice in the spray surface, the air mixing conduit having a longitudinal axis, wherein the air mixing conduit is inwardly inclined at an acute angle with respect to the longitudinal axis of the coating material conduit, the angle defined by the angle formed by the intersection of the longitudinal axis of the coating material conduit and the longitudinal axis of the air mixing conduit, the angle being between 10° and 70°, so that hot gas discharge from the air mixing orifice converges with the gas discharges from the plurality of air orifices and the axis of the exiting molten polymer a predetermined distance from the spray surface.

23. The thermal spray apparatus of claim 15, wherein the source of pressurized molten polymer coating material comprises:

a) a screw extruder to convert a solid polymer to a molten polymer state; and b) a heated supply conduit fluidly connected to the screw extruder and the input coating passage, wherein the heated supply conduit maintains the polymer in the molten polymer state.

24. A thermal spray apparatus for coating a substrate with a polymer coating material, the thermal spray apparatus comprising:

a) a source of pressurized molten polymer coating material;

b) a source of pressurized hot gas for generating a flowstream; and c) a spray head having a nozzle assembly for directing the flowstream towards the substrate, the nozzle assembly having a spray surface, a hot air receiving chamber in fluid communication with the source of pressurized hot gas, a plurality of air delivery conduits extending from the hot air receiving chamber to the spray surface to define a plurality of air orifices in the spray surface, and a coating material conduit in fluid communication with the source of pressurized molten polymer coating material, the coating material conduit defining a material orifice in the spray surface, wherein the coating material conduit has a longitudinal axis, wherein each air delivery conduit has a longitudinal axis, wherein the plurality of air orifices at least partially surround a portion of the material orifice, and wherein the plurality of air delivery conduits are inclined and skewed with respect to the longitudinal axis of the coating material conduit, wherein the molten polymer exits the material orifice along an axis co-axial to the longitudinal axis of the coating material conduit, and wherein each of the air delivery conduits has a major direction component in a direction radially inwardly with respect to the longitudinal axis of the coating material conduit, the radially inwardly component being skewed with respect to the radial direction of the longitudinal axis of the coating material conduit so that hot gas discharges from the plurality of air orifices avoid the axis of the exiting molten polymer.

25. The thermal spray apparatus of claim 24, wherein each of the air delivery conduits are inclined at an acute angle, the angle defined by the longitudinal axis of the air delivery conduit and a plane passing through the longitudinal axis of the coating material conduit and the air orifice, the angle being between 10° and 70°, and wherein the skew angle is between 20° and 80°.

26. The thermal spray apparatus of claim 24, further comprising an air mixing conduit extending from the hot air receiving chamber to the spray surface to define an air mix orifice in the spray surface, the air mixing conduit having a longitudinal axis, wherein the air mixing conduit is inwardly inclined at an acute angle with respect to the longitudinal axis of the coating material conduit, the angle defined by the angle formed by the intersection of the longitudinal axis of the coating material conduit and the longitudinal axis of the air mixing conduit, the angle being between 10° and 70°, so that hot gas discharge from the air mixing orifice converges with the gas discharges from the plurality of air orifices and the axis of the exiting molten polymer a predetermined distance from the spray surface.

27. A thermal spray apparatus for coating a substrate with a polymer coating material, the thermal spray apparatus comprising:

a spray head having:

a) an input coating passage adapted to be in fluid communication with a source of pressurized molten polymer coating material;

b) an input air passage adapted to be in fluid communication with a source of pressurized hot gas; and c) a nozzle assembly, the nozzle assembly having a spray surface, a hot air receiving chamber in fluid communication with the input air passage, a plurality of air delivery conduits extending from the hot air receiving chamber to the spray surface to define a plurality of air orifices in the spray surface, and a coating material conduit extending from the input coating passage to the spray surface to define a material orifice in the spray surface, wherein the coating material conduit has a longitudinal axis, wherein each air delivery conduit has a longitudinal axis, wherein the plurality of air delivery conduits are inclined and skewed with respect to the longitudinal axis of the coating material conduit, wherein the molten polymer exits the material orifice along an axis co-axial to the longitudinal axis of the coating material conduit, wherein each of the air delivery conduits has a major direction component in a direction radially inwardly with respect to the longitudinal axis of the coating material conduit, the radially inwardly component being skewed with respect to the radial direction of the longitudinal axis of the coating material conduit so that hot gas discharges from the plurality of air orifices avoid the axis of the exiting molten polymer, and wherein the plurality of air orifices at least partially surround a portion of the material orifice, so that, when the pressurized hot gas exits the plurality of air orifices and the pressurized coating material exits the material orifice, the coating material is atomized and transported to the substrate in a molten state.

28. The thermal spray apparatus of claim 27, wherein the coating material conduit has a longitudinal axis, wherein each air delivery conduit has a longitudinal axis, and wherein the plurality of air delivery conduits are inclined inwardly toward the material orifice of the coating material conduit to form an acute angle relative to the longitudinal axis of the coating material conduit, the angle defined by the longitudinal axis of the air delivery conduit and a plane passing through the longitudinal axis of the coating material conduit and the air orifice of the air delivery conduit, so that the pressurized hot gas exiting the plurality of air orifices converges with the molten polymer exiting the material orifice.

29. The thermal spray apparatus of claim 28, wherein the nozzle assembly has a substantially "L" shape in cross-section having a base portion and an upright portion, the base portion extending outwardly away from the upright portion substantially co-axial to the longitudinal axis of the coating material conduit, a portion of the upright portion forming the spray surface, and wherein the material orifice is proximate the base portion of the nozzle assembly.

30. The thermal spray apparatus of claim 27, wherein each of the air delivery conduits are inclined at an acute angle, the angle defined by the longitudinal axis of the air delivery conduit and a plane passing through the longitudinal axis of the coating material conduit and the air orifice, the angle being between 10° and 70°.

31. The thermal spray apparatus of claim 30, wherein the skew angle is between 20° and 80°.

32. The thermal spray apparatus of claim 27, further comprising an air mixing conduit extending from the hot air receiving chamber to the spray surface to define an air mix orifice in the spray surface, the air mixing conduit having a longitudinal axis, wherein the air mixing conduit is inwardly inclined at an acute angle with respect to the longitudinal axis of the coating material conduit, the angle defined by the angle formed by the intersection of the longitudinal axis of the coating material conduit and the longitudinal axis of the air mixing conduit, the angle being between 10° and 70°, so that hot gas discharge from the air mixing orifice converges with the gas discharges from the plurality of air orifices and molten polymer discharged from the material orifice a predetermined distance from the spray surface.

* * * * *